United States Patent [19]

King et al.

[11] Patent Number: 4,458,967

[45] Date of Patent: Jul. 10, 1984

[54] CONNECTOR FOR SHIELDED FLAT CABLE

[75] Inventors: William A. King, Aurora; Glenn S. Mills, Elgin, both of Ill.

[73] Assignee: Cooper Industries, Inc., Houston, Tex.

[21] Appl. No.: 339,411

[22] Filed: Jan. 15, 1982

[51] Int. Cl.[3] ..... H01R 3/04; H01R 13/38

[52] U.S. Cl. ..... 339/14 R; 339/99 R; 339/143 R

[58] Field of Search ..... 339/99 R, 97 R, 97 P, 339/98, 14 R, 143

[56] References Cited

U.S. PATENT DOCUMENTS

| | | | |
|---|---|---|---|
| 3,255,429 | 6/1966 | Forney | 339/99 |
| 3,601,768 | 8/1971 | Lightner | 339/103 M |
| 3,864,011 | 2/1975 | Huber | 339/103 M |
| 3,907,396 | 9/1975 | Huber | 339/103 R |
| 3,912,354 | 10/1975 | Campbell et al. | 339/99 R |
| 3,963,319 | 6/1976 | Schumacher et al. | 339/176 |
| 4,023,877 | 5/1977 | Hennessey et al. | 339/17 F |
| 4,054,348 | 10/1977 | Stroupe et al. | 339/91 |
| 4,073,560 | 2/1978 | Anhalt et al. | 339/99 R |
| 4,111,512 | 9/1978 | Parmer et al. | 339/105 |
| 4,209,215 | 6/1980 | Verma | 339/99 R |
| 4,278,314 | 7/1981 | Moser et al. | 339/99 R |
| 4,332,433 | 6/1982 | Balde et al. | 339/99 R |

FOREIGN PATENT DOCUMENTS

| | | | |
|---|---|---|---|
| 9337 | 2/1980 | European Pat. Off. | 339/105 |
| 2921805 | 12/1979 | Fed. Rep. of Germany | 339/99 R |

*Primary Examiner*—Joseph H. McGlynn
*Attorney, Agent, or Firm*—Fitch, Even, Tabin & Flannery

[57] ABSTRACT

A connector for shielded flat electrical cable provides for electrical connection of the cable shield through electrical contacts of the connector. The connector comprises a contact housing with electrical contacts, a cover and a shield clamp which may also serve as a strain relief member. A conducting surface on at least one of the cover and the clamp makes electrical contact with the cable shield when the connector is assembled. The conducting surface is electrically connected with at least one of the electrical contacts so as to permit electrical connection of the shield when the connector is mated with another connector or an electrical device.

7 Claims, 6 Drawing Figures

Fig. 1
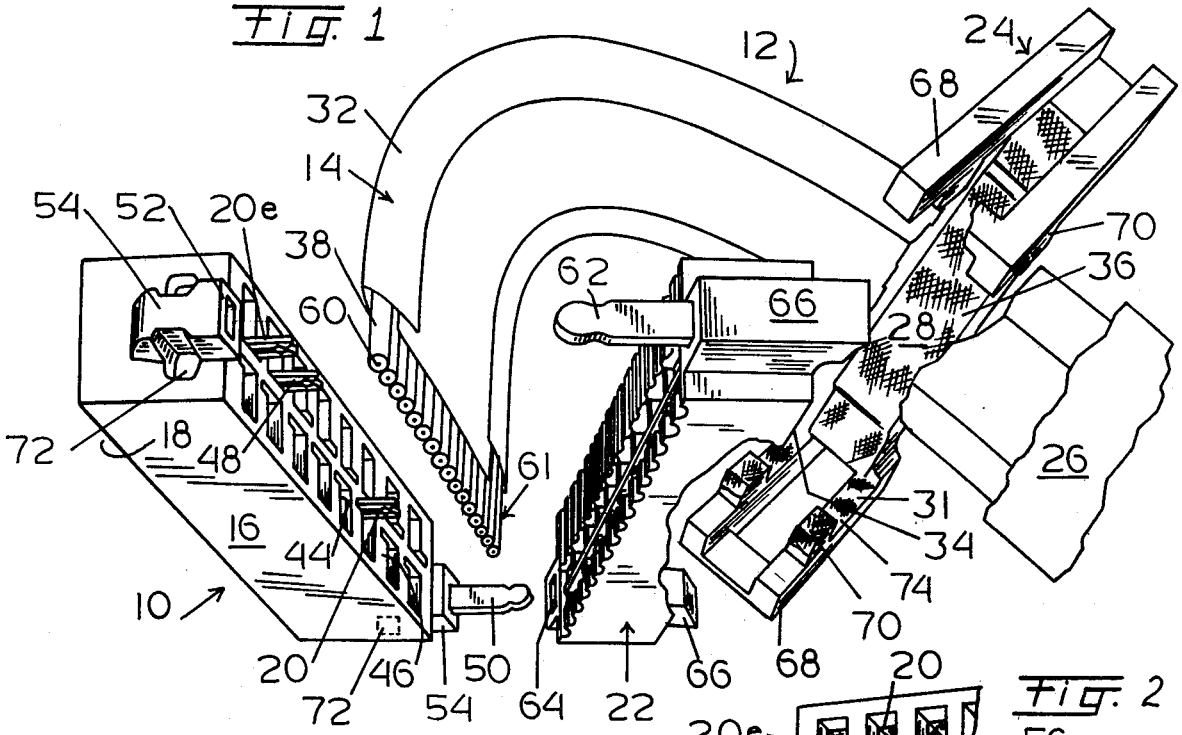
Fig. 2
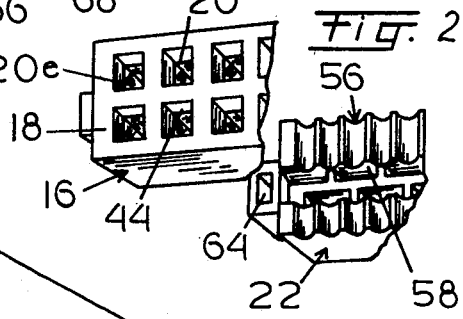
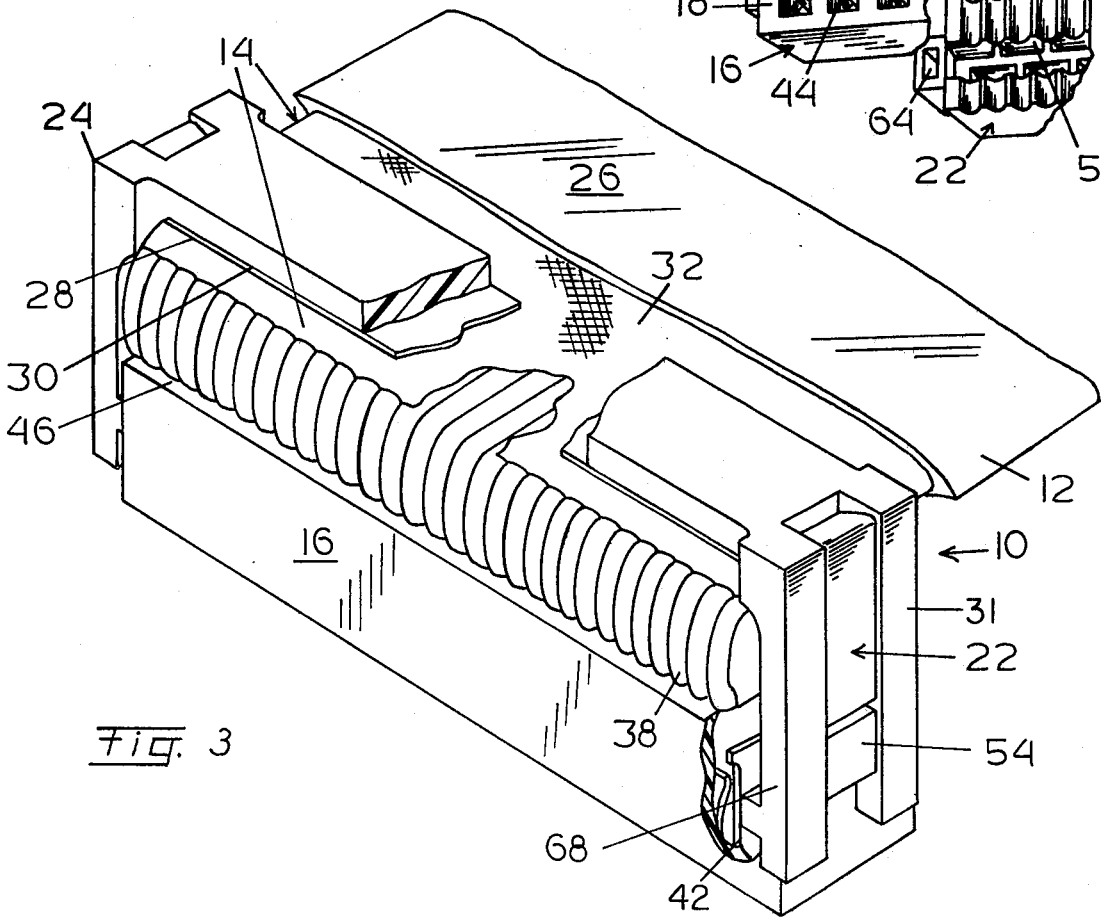
Fig. 3

Fig. 4
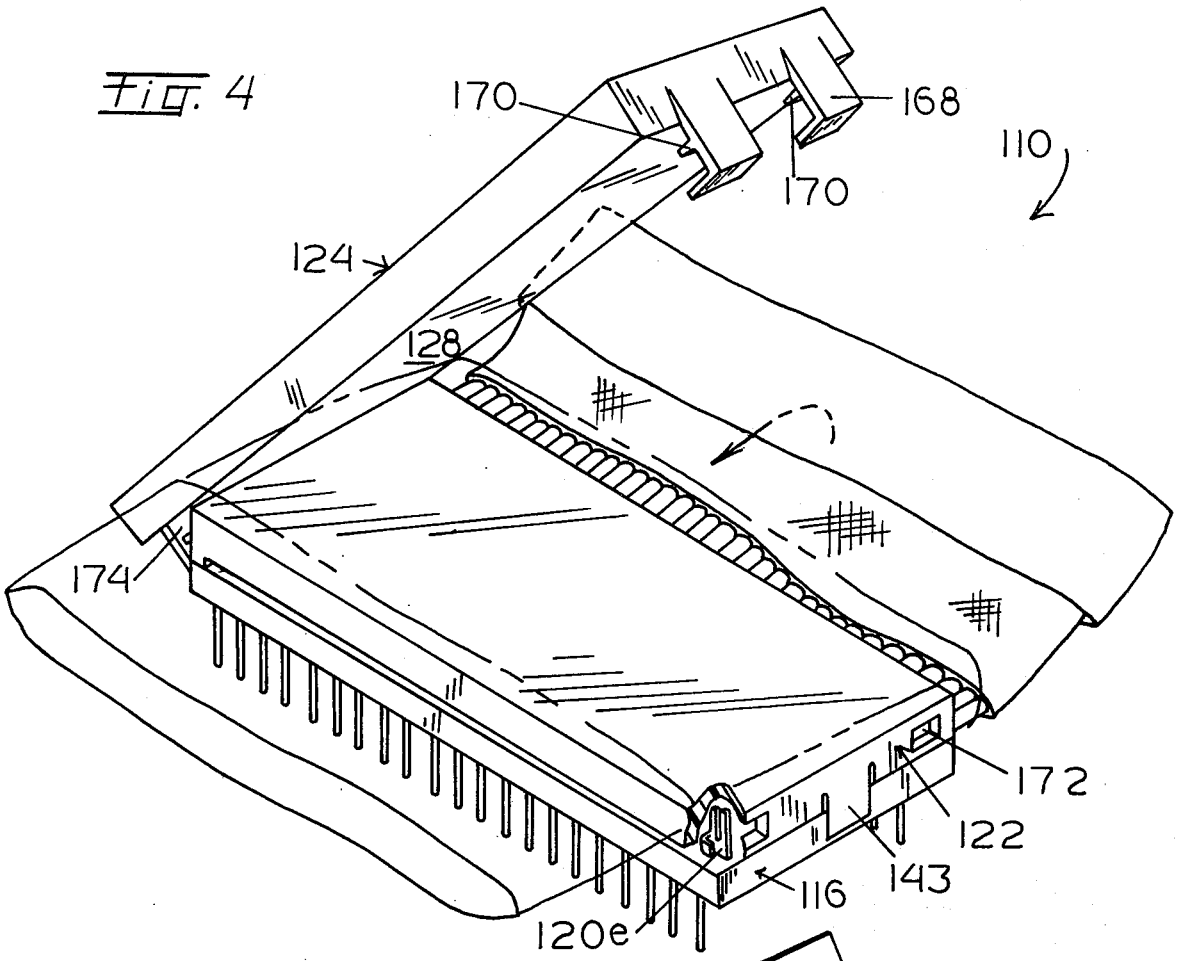
Fig. 5
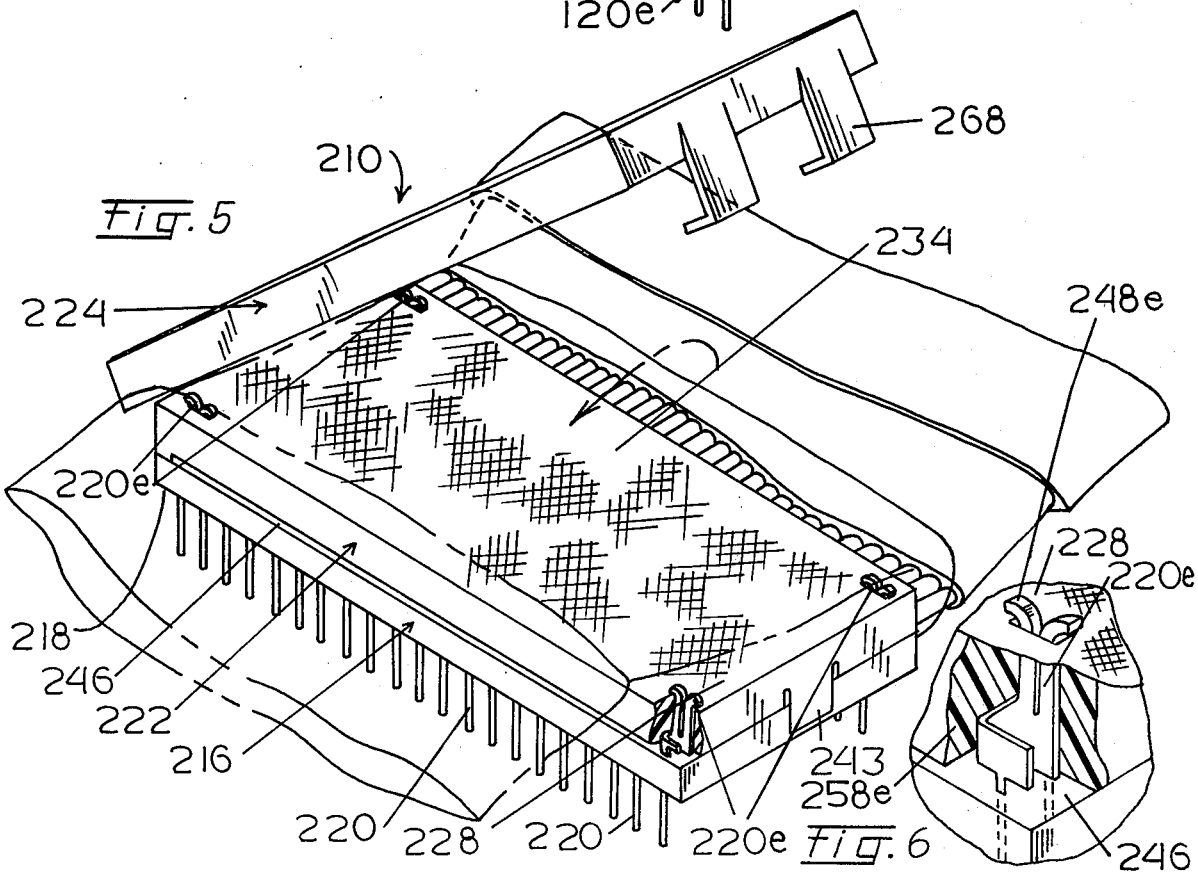
Fig. 6

CONNECTOR FOR SHIELDED FLAT CABLE

BACKGROUND OF THE INVENTION

The present invention relates to a connector for a shielded flat electrical cable, and in particular to such a connector which also provides strain relief.

There are many known connectors for flat electrical cables providing for the ready connection and disconnection of such cables to and from electrical components and other cables. Many of these connectors provide a strain relief function.

A problem arises in the connection of shielded flat cables. Available connectors do not provide convenient means for connecting the shield of a shielded flat electrical cable. Soldering is sometimes used to connect a shield drain wire to the circuit board. However, disconnection of soldered contacts is cumbersome.

Accordingly, it is a primary object of the present invention to provide an improved connector for shielded flat electrical cable which permits ready electrical connection and disconnection of the shield as well as the cable conductors. Additionally, it is an object of the present invention to provide such a connector which also serves a strain relief function.

SUMMARY OF THE INVENTION

In accordance with the present invention, a connector provides for electrically connecting a cable shield through the electrical contacts of the connector. The connector comprises a contact housing with electrical contacts fitted therein, a cover for maintaining the cable against the electrical contacts, and a shield clamp which may also serve as a strain relief member.

A conducting surface is bonded to at least one of the shield clamp and the cover. A cable sheath is removed from the portion of the cable extending between the shield clamp and the cover so that the cable shield engages the conducting surface. Means are provided for electrically connecting the conducting surface to at least one of the electrical contacts. Upon connection of the connector, the aforementioned electrical contact may engage an electrical contact of another connector or electrical device so as to provide convenient means for electrically connecting the cable shield. Disconnection is also conveniently effected in the manner of connectors lacking provisions for electrically connecting a cable shield. Means are provided for locking engagement of the cover and the contact housing and for locking engagement of the shield clamp with at least one of the cover and the contact housing.

In a first embodiment, the conducting surface is bonded to a face of the shield clamp in the form of a strain relief member and is disposed so as to contact the cable shield extending between the strain relief and the cover. The contact housing has lateral openings exposing certain electrical contacts. The strain relief member has brackets with metallized protrusions. Upon assembly of the connector, the protrusions extend through the openings so as to effect physical and electrical contact with the respective electrical contacts. The brackets have metal surfaces extending between the conducting surface and the metallized protrusions to complete an electrical connection between the cable shield and the electrical contacts. The metallized protrusions and the openings cooperate to effect engagement of the strain relief member with the contact housing.

A second preferred embodiment differs from the first in that the openings to the contacts are in the cover rather than the contact housing. Metallized protrusions of the strain relief member effect physical and electrical contact with respective contacts. The metallized protrusions cooperate with the openings to effect locking engagement of the strain relief member with the cover.

In a third embodiment the conducting surface is bonded to the cover. Extended electrical contacts are elongated to protrude through the cover and the conducting surface; flared tines of the extended contacts effect physical and electrical contact with the conducting surface. When the cable shield is engaged by the conducting surface and the connector is connected to another connector or to an electrical device, the cable shield may be electrically connected through the respective extended contacts.

In each of the embodiments, electrical connection of the cable shield is effected when the respective contacts in the cable connector are connected to contacts of the connector or electrical device to which connection is made. As is readily apparent, this electrical contact is effected/broken automatically with the connection/disconnection of the connector in the usual manner. A strain relief function is provided in a manner well known in the art by the doubling-back of the cable about the cover. Thus the connector of the present invention permits ready electrical connection of a cable shield, while also providing a strain relief function.

BRIEF DESCRIPTION OF THE DRAWINGS

FIG. 1 is a perspective view of a connector in accordance with a first preferred embodiment of the present invention prior to assembly, with certain parts broken away.

FIG. 2 is a partial perspective view of the connector FIG. 1 showing portions of the contact housing and cover.

FIG. 3 is a perspective view of an assembled connector in accordance with the first preferred embodiment of the present invention, with certain parts broken away.

FIG. 4 is a perspective view of a partially assembled connector in accordance with a second preferred embodiment of the present invention.

FIG. 5 is a perspective view of a partially assembled connector in accordance with a third preferred embodiment of the present invention.

FIG. 6 is an enlarged view of part of the connector of FIG. 5.

DESCRIPTION OF THE PREFERRED EMBODIMENTS

A connector 10 for a shielded flat electrical cable 12 provides electrical connection of a cable shield 14 through one or more electrical contacts 20*e* of the connector 10. The connector 10 comprises a contact housing 16 with a mating face 18 (for connection to another connector or an electrical device) and electrical contacts 20, a cover 22 and a shield clamp in the form of a strain relief member 24, as illustrated in FIG. 1. The connector 10 is designed to be assembled about the shielded flat electrical cable 12 as shown in FIG. 3. The cable sheath 26 is stripped back a distance, and the cable shield 14 is stripped back a lesser distance, giving the cable 12 a three-tiered appearance. As is well known in the art, the doubling of the cable 12 back upon itself around the cover 22 provides strain relief.

A problem addressed by the present invention is the formation of a convenient electrical connection between the cable shield 14 and a connector or device to which the terminated cable 12 is to be connected. Prior flat cable connectors make no provision for such an electrical connection of the cable shield, while others require soldering, which renders disconnecting difficult.

In accordance with the present invention, a conducting surface 28 is disposed adjacent the cable shield 14 where the cable 12 extends between the cover 22 and the strain relief member 24. Metallized extensions 30 electrically connect the conducting surface 28 to at least one electrical contact 20*e* so that the cable shield 14 may be electrically connected therethrough. In this way, the cable shield 14 of the cable 12 may be electrically connected to the electrical contact 20*e* automatically as the strain relief member 24 is attached to the contact housing 16 and the cover 22, as shown in FIG. 3. The conducting surface may be bonded to the strain relief member, as in the first and second preferred embodiments, or to the cover, as in the third preferred embodiment.

The connector 10 is shown assembled in FIG. 3. A portion 32 of the cable 12 with the sheath 26 removed and the cable shield 14 intact extends between a cable shield contact face 34 of the cover and a cable shield contact face 36 of the strain relief member 24. The conducting surface 28 of at least one of the two faces 34/36 makes electrical and physical contact with the cable shield 14. The cable 12 doubles back upon itself, and a portion 38 of the cable 12 with the cable shield 14 removed extends between the contact housing 16 and the cover 22, making electrical contact with the electrical contacts 20 in a manner well known in the art.

Describing the first preferred embodiment, illustrated in FIGS. 1, 2 and 3, in greater detail, the connector 10 comprises the contact housing 16 with electrical contacts 20, the cover 22 and the strain relief member 24. The mating face 18 of the contact housing 16 is designed to interface with another connector or device. The contacts 20 extend from adjacent the mating face 18 through passageways 44 in the the contact housing 16, and through a cable engaging face 46 of the contact housing 16.

Each electrical contact 20 is of conducting material and includes an insulation displacing portion with two insulation piercing tines 48. The tines 48 of each contact 20 straddle and electrically and physically contact a respective conductor wire 60 of the cable 12 upon assembly of the connector 10. Upon connection of the connector with another connector or electrical device, the wires 60 are electrically connected with respective conductors through the electrical contacts 20.

The contact housing 16 includes means for engaging the cover 22. In the illustrated embodiment, a pin 50 at one lateral extremity of the contact housing 16 and a cavity 52 at the other lateral extremity serve as means for engaging reciprocal means associated with the cover 22. In the illustrated embodiment, lateral protrusions 54 of the contact housing, which incorporate the pin 50 and the cavity 52 serve as means for engaging the strain relief member 24.

The cover 22 includes a cable supporting face 56 with contact receiving passages 58 therethrough for receiving portions of the contact tines 48 snugly therein. The cable supporting face 56 of the cover 22 is preferably serrated to conform to the individual insulated conductor wires 60 of a cable core 61. The shield contact face 34 of the cover is opposite the cable supporting face 56 of the cover 22. A pin 62 and a cavity 64 arrangement are provided to engage the similar components of the contact housing 16. Two nubs 66 serve to align the strain relief member 24 in relation to the cover 22.

The strain relief member 24 includes its cable shield contact face 36, to which conducting material is bonded for making electrical contact with the cable shield 14. The strain relief member 24 includes brackets 68, which serve as means for engaging the cover 22 and as means for engaging the contact housing 16 as shown in FIG. 3.

The metallized extensions 30 of the brackets 68 include metallized protrusions 70 which, when the connector 10 is assembled, extend through lateral openings 72 in the contact housing 16 to make electrical contact with the respective end electrical contacts 20*e*. The metallized extensions 30 also include inward surfaces 74 which are metallized so that electrical connection is made between the conducting surface 28 and the metallized protrusions 70. Thus, when the connector 10 is assembled, electrical contact is made between the cable shield 14 and the end electrical contacts 20*e* of the connector 10, providing a convenient means of electrically connecting the cable shield 14 upon connection of the connector 10 to another cable or device.

A second preferred embodiment, a D.I.P. connector 110, is illustrated in FIG. 4. The connector 110 includes a contact housing 116, a cover 122 and a strain relief member 124. The connector 110 may be assembled about a cable in a manner similar to that of the connector 10 of the first embodiment.

In this second embodiment, openings 172 permitting electrical contact between a conducting surface 128 of the strain relief member 124 and electrical contacts 120*e* are in the cover 122. Metallized protrusions 170 on brackets 168 of the strain relief member 124 can extend into the openings 172 to make electrical contact. The conducting surface 128, metallized inward surfaces 174 of the brackets 168, the metallized protrusions 170 and the contacts 120*e*, successively, provide an electrical path through which the cable shield may be electrically connected via electrical contacts associated with a mating connector or device.

In this embodiment, it is convenient to allow the metallized protrusions 170 of the strain relief member 124 and the openings 172 to serve as cooperating engagement means for engaging the strain relief member 124 and the cover 122. The cover 122 engages the contact housing 116 by means of a clip 143.

Describing the third preferred embodiment of the present invention, a connector 210 is shown (FIGS. 5 and 6) comprising a contact housing 216 with electrical contacts 220, a cover 222 and a strain relief member 224. The contact housing 216 includes passageways from a mating face 218 through the housing 216 to a cable engaging face 246. The electrical contacts 220 extend at least partially through these passageways. The illustrated pin-type electrical contacts 220 extend entirely through the contact housing 216.

The four end electrical contacts 220*e* extend further than the other contacts 220 from the cable engaging face 246 of the contact housing 226 and have flared tines 248*e* for making electrical contact with a conducting surface 228 on a cable shield contact face 234 of the cover 222. The cover 222 includes contact receiving passageways for receiving tines of electrical contacts 220 therein, as in the first and second preferred embodiments. End passageways 258*e*, corresponding to an extended electrical contacts 220*e*, extends completely through the cover to permit the flared tines 248*e* to contact the conducting surface 228. When the connector is assembled, the cable shield 14 is electrically and physically contacted by the conducting surface 228, and is thereby electrically connected to the end electrical contacts 220*e*. Upon connection to another connector or device, these end contacts 220*e* may engage electrical contacts to provide convenient electrical connection of the cable shield 14.

Cooperating means, including a clip 243, associated with the cover 222 and the contact housing 216 provide for locking engagement thereof. Further cooperating means, including a clip 268, provide for locking engagement of the strain relief member 224 with the contact housing 216. Alternatively, the strain relief member could be engaged with the cover 222 or with both the contact housing 216 and the cover 222.

The embodiments above may be varied to accommodate particular applications. The present invention is applicable to a variety of connector types with other types of connecting relationships. The above embodiments are presented as exemplars, and are not intended to limit the spirit and scope of the present invention.

What is claimed is:

1. A mass termination, insulation displacement connector for use with a shielded flat cable of the type including a generally planar array of parallel conductors embedded in insulation, an electrically conductive shield at least partially encompassing said insulation and an insulative outer sheath, said connector comprising:

an elongate insulative housing having a cable engaging face and a mating face and a plurality of contact passages extending therebetween with each passage aligned with a corresponding conductor of said flat cable;

an electrical contact mounted in each of said passages, each contact having a matable portion disposed adjacent said mating face and an insulation displacement portion extending beyond said cable engaging face for terminating a corresponding conductor, one of said contacts being a grounding contact;

an elongate insulative cover having a cable supporting face provided with an array of passages positioned to receive the insulation displacement portions of said contacts, said housing and cover cooperating to hold a portion of said cable with said sheath and shield removed and relative closing movement of said housing and cover effecting termination of said conductors by said contacts, said cover having a remote surface for engaging the surface of the cable bent back upon itself;

an elongate clamp for overlying said cover to hold the bent back portion of the cable therebetween, said clamp being latchable to said housing and having a shielding contact surface facing said cover remote surface for engaging the shield with a portion of said sheath removed, said clamp having at least one leg extending alongside said cover and further comprising an electrically conductive path including said leg for electrically connecting said shield to said grounding contact.

2. A connector as set forth in claim 1 wherein said housing has first and second spaced sides, said clamp being releasably latchable to said housing and including first and second brackets extending along said sides and latching thereto, said first bracket including said leg.

3. A connector as set forth in claim 1 wherein said connector includes at least one lateral opening intersecting a passage for receiving said grounding contact, said leg carrying a protrusion for reception in said opening to engage said grounding contact.

4. A connector as set forth in claim 3 wherein said opening is in said housing.

5. A connector as set forth in claim 3 wherein said opening is in said cover.

6. A connector as set forth in claim 3 wherein said conductive path includes said shielding contact surface, said leg and said protrusion.

7. A mass termination, insulation displacement connector for use with a shielded flat cable of the type including a generally planar array of parallel conductors embedded in insulation, an electrically conductive shield at least partially encompassing said insulation and an insulative outer sheath, said connector comprising:

an elongate insulative housing having a cable engaging face and a mating face and a plurality of contact passages extending therebetween with each passage aligned with a corresponding conductor of said flat cable;

an electrical contact mounted in each of said passages, each contact having a matable portion disposed adjacent said mating face and an insulation displacement portion extending beyond said cable engaging face for terminating a corresponding conductor, at least one of said contacts being a grounding contact;

an elongate insulative cover having a cable supporting face provided with an array of passages positioned to receive the insulation displacement portions of said contacts, said housing and cover cooperating to hold a portion of said cable with said sheath and shield removed and relative closing movement of said housing and cover effecting termination of said conductors by said contacts, said cover having a remote conductive face for physically and electrically contacting said shield exposed in a bent back portion of said cable, said conductive face having at least one opening corresponding in position to said grounding contact, said grounding contact extending further from said housing than other of said contacts and extending through said opening to make contact with said conductive face when said housing and cover are assembled;

a shielding clamp having a face, which opposes said conducting face when said connector is assembled so as to define a passage for said bent back cable portion therebetween;

means for engaging said cover with said contact housing; and means for engaging said shielding clamp with at least one of said contact housing and said cover.

* * * * *

UNITED STATES PATENT AND TRADEMARK OFFICE

CERTIFICATE OF CORRECTION

PATENT NO. : 4,458,967

DATED : July 10, 1984

INVENTOR(S) : William A. King and Glenn S. Mills

It is certified that error appears in the above-identified patent and that said Letters Patent is hereby corrected as shown below:

Column 3, line 11, after "extends" insert --through a cable passageway 30 formed--;

Column 3, line 43, delete the second occurrence of "the";

Column 3, line 12, replace "30" with --31--;

Column 4, line 13, replace "30" with --31--;

Column 4, line 23, after "and" insert --the legs 42 of--.

Signed and Sealed this

First Day of January 1985

[SEAL]

*Attest:*

*Attesting Officer*

GERALD J. MOSSINGHOFF

*Commissioner of Patents and Trademarks*